US008834023B1

(12) United States Patent
Laera

(10) Patent No.: US 8,834,023 B1
(45) Date of Patent: Sep. 16, 2014

(54) BAG OPENING DEVICE

(76) Inventor: Vito J. Laera, Woodmere, NY (US)

( * ) Notice: Subject to any disclaimer, the term of this patent is extended or adjusted under 35 U.S.C. 154(b) by 408 days.

(21) Appl. No.: 13/212,376

(22) Filed: Aug. 18, 2011

(51) Int. Cl.
*B65D 33/00* (2006.01)

(52) U.S. Cl.
USPC ..... 383/33

(58) Field of Classification Search
CPC ... B65B 67/1238; B65B 67/12; B65F 1/1415; B65D 2563/107; B65D 67/1238; B65D 67/12
USPC ..... 383/33, 34, 71; 24/30.5 R, 16 PB, 16 R
See application file for complete search history.

(56) References Cited

U.S. PATENT DOCUMENTS

| | | | | | |
|---|---|---|---|---|---|
| 209,723 | A | * | 11/1878 | Stowell | 383/72 |
| 665,942 | A | * | 1/1901 | Tabler | 383/74 |
| 1,040,324 | A | * | 10/1912 | Hill | 383/71 |
| 1,235,865 | A | * | 8/1917 | Whiteker | 224/610 |
| 1,351,388 | A | * | 8/1920 | Kabaci | 383/25 |
| 1,466,658 | A | * | 9/1923 | Jones | 383/71 |
| 1,645,818 | A | * | 10/1927 | Overboe et al. | 210/495 |
| 3,627,243 | A | * | 12/1971 | Farrelli | 248/99 |
| 3,915,329 | A | | 10/1975 | Zaks | |
| 4,718,556 | A | * | 1/1988 | Hildebrandt | 383/205 |
| 4,785,960 | A | * | 11/1988 | Belisle | 220/23.83 |
| 4,932,576 | A | * | 6/1990 | Ashley | 224/673 |
| 4,979,547 | A | | 12/1990 | Hoerner | |
| 5,060,893 | A | | 10/1991 | Halbert | |
| 5,160,196 | A | * | 11/1992 | Curtis | 383/33 |
| 5,346,311 | A | * | 9/1994 | Siler et al. | 383/75 |
| 5,871,037 | A | | 2/1999 | Feldt | |
| 6,030,010 | A | * | 2/2000 | Graeff | 294/214 |
| 6,340,037 | B1 | | 1/2002 | Stafford | |
| 6,604,717 | B2 | * | 8/2003 | Stanfield | 248/99 |
| 6,953,194 | B2 | * | 10/2005 | Brockway | 277/576 |
| 7,273,139 | B2 | * | 9/2007 | Lantz | 190/101 |
| 7,461,821 | B2 | * | 12/2008 | Cheng | 248/99 |
| 7,641,154 | B2 | * | 1/2010 | Register | 248/99 |
| 7,753,322 | B1 | * | 7/2010 | Peterson | 248/99 |
| 8,720,834 | B2 | * | 5/2014 | Scobey, Jr. | 248/99 |
| 2004/0258333 | A1 | * | 12/2004 | Nokano | 383/202 |
| 2006/0010659 | A1 | * | 1/2006 | Penn | 24/273 |

FOREIGN PATENT DOCUMENTS

| | | | | | |
|---|---|---|---|---|---|
| JP | 2002167004 | A | * | 6/2002 | B65F 1/06 |

* cited by examiner

*Primary Examiner* — Jes F Pascua
(74) *Attorney, Agent, or Firm* — Crossley Patent Law; Micah C. Gunn

(57) ABSTRACT

A bag opening device that includes a strip having a distal end and a proximal end, the distal end insertible through a central slit disposed in a lock, said lock disposed on the proximal end, which lock has a locking tab to releasably engage with a plurality of slots disposed along the length of the strip, whereby the strip forms a rigid circumference securable to a particular bag opening by means of a clip and a plurality of securing ties, said bag thereby held open to more easily dispose of items therein.

3 Claims, 4 Drawing Sheets

BAG OPENING DEVICE

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of bag opening devices are known in the prior art. However, what is needed is a bag opening device that includes a strip having a distal end and a proximal end, the distal end insertible through a central slit disposed in a lock, said lock disposed on the proximal end, which lock has a locking tab to releasably engage with a plurality of slots disposed along the length of the strip, whereby the strip forms a rigid circumference securable to a particular bag opening by means of a clip and a plurality of securing ties, said bag thereby held open to more easily dispose of items therein.

FIELD OF THE INVENTION

The present invention relates to a bag opening device, and more particularly, to a bag opening device that includes a strip having a distal end and a proximal end, the distal end insertible through a central slit disposed in a lock, said lock disposed on the proximal end, which lock has a locking tab to releasably engage with a plurality of slots disposed along the length of the strip, whereby the strip forms a rigid circumference securable to a particular bag opening by means of a clip and a plurality of securing ties, said bag thereby held open to more easily dispose of items therein

SUMMARY OF THE INVENTION

The general purpose of the bag opening device, described subsequently in greater detail, is to provide a bag opening device which has many novel features that result in a bag opening device which is not anticipated, rendered obvious, suggested, or even implied by prior art, either alone or in combination thereof.

When working in the yard and, for example, raking leaves, it is inconvenient to have to open a trash bag to properly encapsulate each shovel load of debris to be deposited therein. A way of holding a bag open, then, to enable the easy deposition of material and debris into the bag without having to open the bag to receive each deposit—and thus deviate from shoveling said debris momentarily—will be useful and time-saving.

The present device, therefore, has been devised to enable a ready and easy way to hold a bag open when working to dispose of items and debris therein. The present bag opening device includes a strip with a distal end and proximal end. This strip is envisioned to be at least one inch in width. When fitted to a bag opening of a specific diameter, the distal end is easily inserted into a slit disposed in a head of a lock. This lock has a locking tab disposed therein, which locking tab releasably engages with each of a plurality of slots disposed at regular intervals along the length of the strip. When the locking tab is depressed away from the distal end, the strip easily moves through the locking head. When the locking tab is released, the locking tab readily engages with each of the plurality of slots to secure the device rigidly around a set circumference. Thusly, a set circumference of a particular diameter, corresponding to a particular bag at hand, may be readily obtained.

The strip is then securable to the bag opening by means of a clip and a plurality of securing ties. The clip includes a pair of edges compressibly forced together by means of a spring. This spring is disposed between a pair of spatulas, each of the pair of spatulas connected to each of the pair of edges. When the pair of spatulas are to forced together contrary the action of the spring, the pair of edges are opened. When the pair of spatulas are released, the action of the spring closes the edges together. Thusly, the clip may be releasably attached to the strip and a bag, to hold the strip about the bag opening.

Each of the plurality of securing ties may be used to further secure the strip in place about the bag's opening. Each securing tie includes an inelastic member with a pair of ends. Each securing tie is configured to reach through a pair of adjacent slots in the strip, wherethrough the pair of ends may be subsequently twisted together to secure the bag and the strip thereto.

Thus has been broadly outlined the more important features of the present bag opening device so that the detailed description thereof that follows may be better understood and in order that the present contribution to the art may be better appreciated.

Objects of the present bag opening device, along with various novel features that characterize the invention are particularly pointed out in the claims forming a part of this disclosure. For better understanding of the bag opening device, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
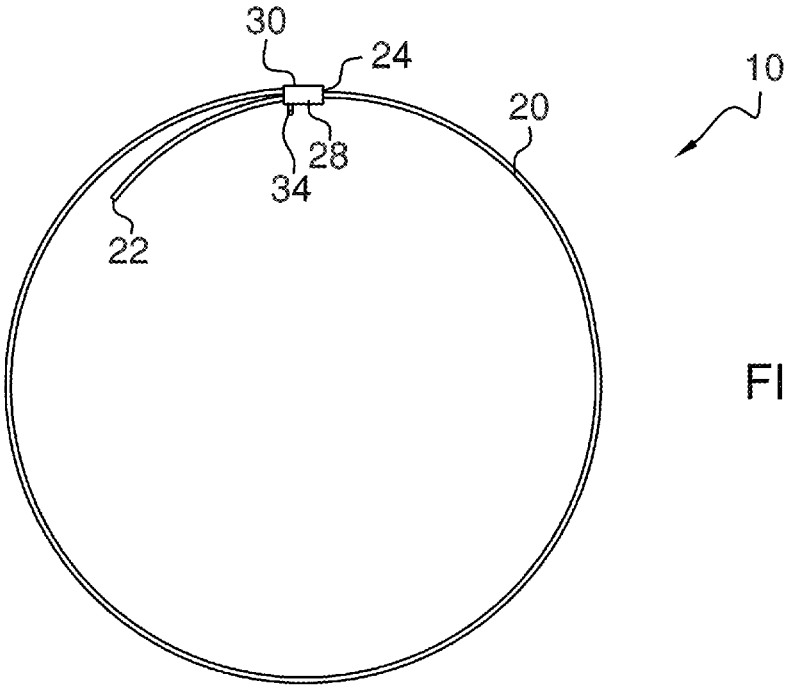
FIG. 1 is a top view.
Figure 2:
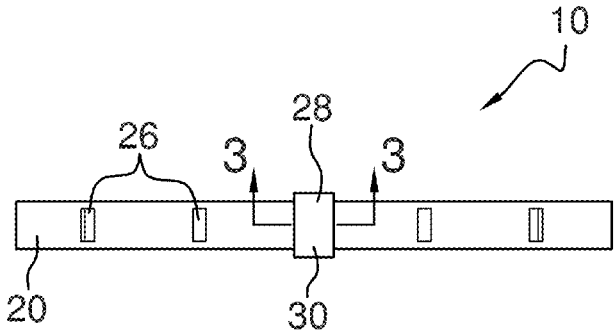
FIG. 2 is a front view.

With reference now to the drawings, and in particular FIGS. 1 through 5 thereof, example of the instant bag opening device employing the principles and concepts of the present bag opening device and generally designated by the reference number 10 will be described.

Referring to FIGS. 1 through 5 a preferred embodiment of the present bag opening device 10 is illustrated.

The bag opening device 10 includes a plastic strip 20 at least one inch wide. The strip 20 has a distal end 22 and a proximal end 24. A plurality of slots 26 is disposed upon the strip 20, said plurality of slots 26 disposed at regular intervals along the length of the strip 20. A lock 28 is disposed on the proximal end 24. The lock 28 includes a parallelepiped head 30, a central slit 32 disposed within the head 30, and a locking tab 34.

The distal end 22 of the strip 20 is insertable into the lock 28 central slit 32 and the locking tab 34 releasably engages with each of the plurality of slots 26. When the locking tab 34 is engaged with a slot 26 the strip 20 forms a rigid circumference applicable to the open end off a bag 36. In such a position, the device 10 functions to maintain the opening of a bag 36 at a set diameter, enabling the efficient and easy disposal of items, as desired, without having to open the bag for each addition of disposed items thereto.

Figure 3:
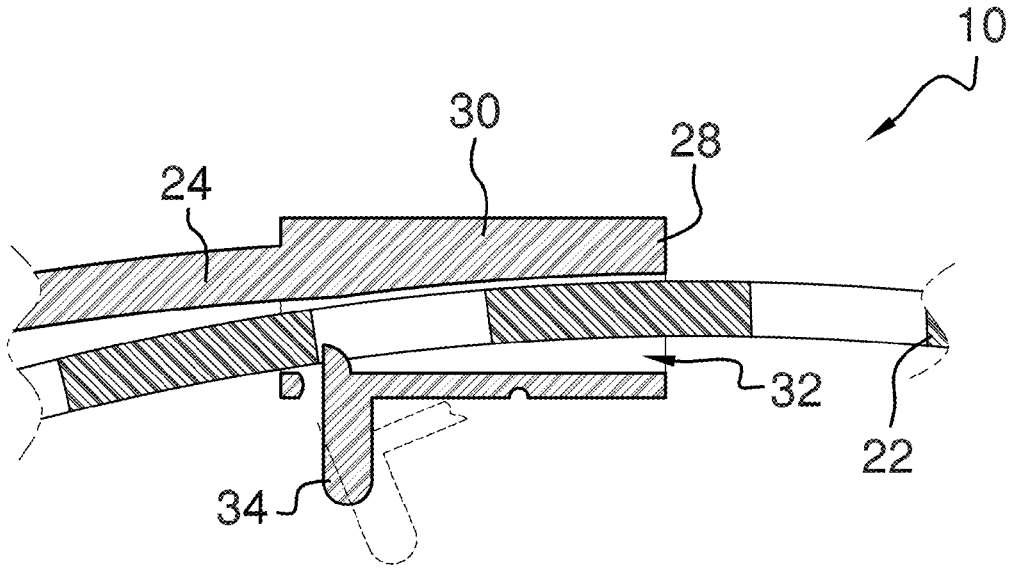
FIG. 3 is a cross section view taken along the line 3-3 of FIG. 2.
Figure 4:
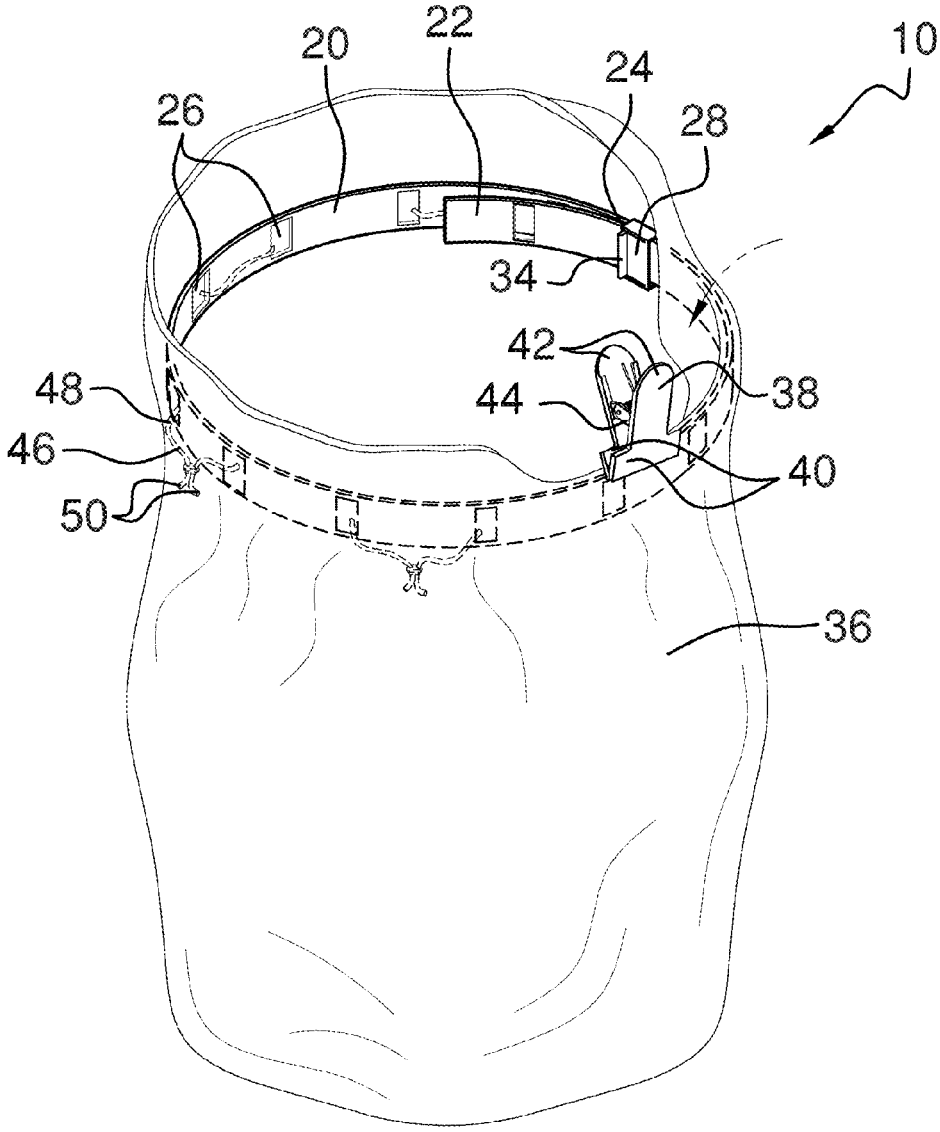
FIG. 4 is an in-use view.
Figure 5:
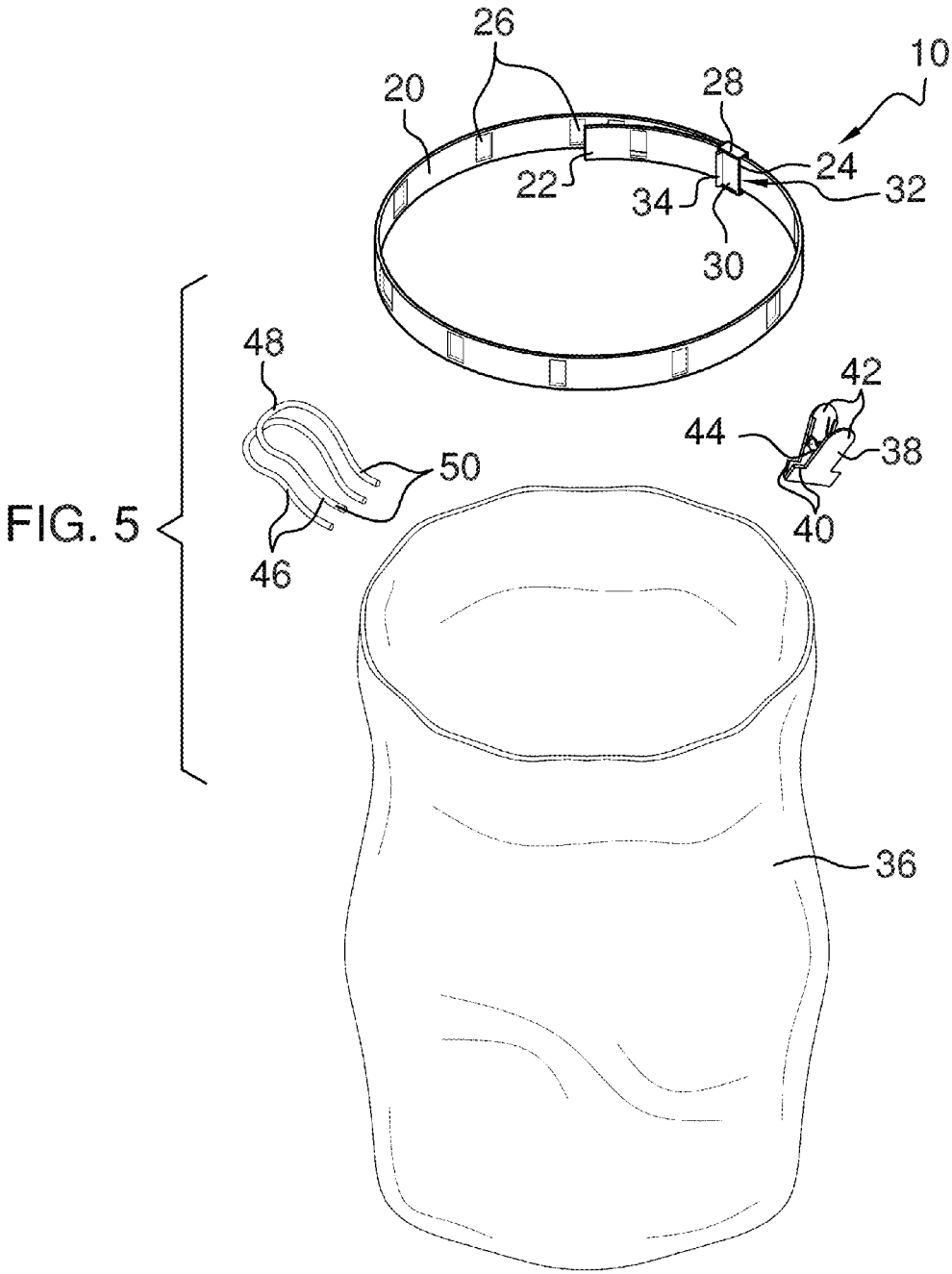
FIG. 5 is an exploded view.

When the locking tab 34 is pulled away from the corresponding slot 26 the lock 28 disengages with the strip 20, and the distal end 22 may be easily removed from within the lock 28 (see FIG. 3). Thus, the device 10 may be easily removed from a bag 36 and the diameter quickly reset to a desired circumference.

The present bag opening device 10 also includes a clip 38, the clip releasably attachable to the strip 20 to secure the strip 20 in the requisite position inside the bag 36 opening. The clip 38 includes a parallelepiped pair of edges 40 and a pair of spatulas 42, each of the pair of spatulas 42 attached to each of the pair of edges 40. A spring 44 is disposed between the pair or spatulas 42. This spring 44 forces the pair of edges 40 together. The edges 40 are separable when the pair of spatulas 42 are forced together, against the action of the spring 44, whereby the clip 38 is releasably attachable to the strip 20 to secure a bag 36 thereto.

The instant bag opening device 10 also includes a plurality of securing ties 46. Each securing tie 46 includes a pliable inelastic member 48 having a pair of ends 50. Each securing tie 46 is configured to reach through a pair of adjacent slots 26 in the strip 20 to further secure the strip 20 to a bag 36 opening when the pair of ends 50 are twisted together.

Thusly, the strip 20 may be inserted into a bag 36 opening, the strip 20 locked at a desired diameter conforming to the diameter of the particular bag 36 opening by means of the lock 28, the locking tab 34 engaging with one of the plurality of slots 26 disposed at regular intervals along the length of the strip 20, and the strip 20 there secured to the bag 36 by means of the clip 38 and the plurality of securing ties 46, as desired. The bag 36 opening is thusly held open for ease of depositing items within the bag 36 without additional effort to open the bag 36 before each deposit therein.

It is envisioned that the strip 20 is friable. The friability of the strip 20 enables a user to easily close the bag 36 and dispose of said bag 36 and its contents simply by crushing the strip 20, the subsequent pieces of the strip 20 disposed within the bag 36 when the bag 36 is thrown away. If desirable, however, the strip 20 may be reused, the securing ties 46 simply untied and the clip 38 released. The device 10 can therefore be removed from the bag 36 opening and reused, as desired.

What is claimed is:

1. A bag opening device comprising:

a plastic strip having a distal end and a proximal end;

a plurality of slots disposed upon the strip;

a lock disposed on the proximal end, the lock comprising:

a parallelepiped head;

a central slit disposed within the head;

a locking tab;

wherein the distal end of the strip is insertable into the lock central slit and the locking tab releasably engages with each of the plurality of slots whereby the strip forms a rigid circumference applicable to the open end off a bag;

wherein the strip has a width of at least 1 inch and the slots are disposed at regular intervals along the length of the strip;

a clip, said clip comprising:

a parallelepiped pair of edges;

a pair of spatulas, each of the pair of spatulas attached to each of the pair of edges;

a spring disposed between the pair or spatulas;

wherein the spring forces the pair of edges together, said edges separable when the pair of spatulas are forced together against the action of the spring, whereby the clip is releasably attachable to the strip to secure a bag thereto; and a plurality of securing ties, each securing tie comprising a pliable inelastic member having a pair of ends, each securing tie configured to reach through a pair of adjacent slots in the strip to secure the strip to a bag opening when the pair of ends are twisted together.

2. The bag opening device of claim 1 wherein the strip is friable.

3. The bag opening device of claim 2 wherein the strip is disposable.

* * * * *